United States Patent [19]

Vaughan

[11] 4,417,934

[45] Nov. 29, 1983

[54] MONITORING A DEPOSIT ON A TRAVELLING WEB

[75] Inventor: Roger Vaughan, Pill, England

[73] Assignee: Imperial Group plc, Bedminster, England

[21] Appl. No.: 312,120

[22] Filed: Oct. 16, 1981

[30] Foreign Application Priority Data

Nov. 5, 1980 [GB] United Kingdom ..... 8035614

[51] Int. Cl.[3] ..... B32B 31/24

[52] U.S. Cl. ..... 156/64; 53/53; 118/688; 131/69; 131/905; 131/907; 131/910; 156/378; 324/61 R; 427/8; 427/10

[58] Field of Search ..... 131/67, 69, 905, 907, 131/910; 156/64, 378; 324/61 R; 427/8, 9, 10; 53/53; 118/688

[56] References Cited

U.S. PATENT DOCUMENTS

| | | | |
|---|---|---|---|
| 3,619,328 | 11/1971 | Preston et al. | 131/69 X |
| 3,899,863 | 8/1975 | Seragnoli et al. | 53/53 |
| 4,251,566 | 2/1981 | Gingerich | 427/10 |
| 4,272,718 | 6/1981 | Kashiuchi et al. | 324/61 R |

*Primary Examiner*—Robert A. Dawson

*Attorney, Agent, or Firm*—Larson and Taylor

[57] ABSTRACT

Method of monitoring a line of adhesive deposited on a travelling paper web to check for accidental omission of adhesive wherein the adhesive has a distinguishing relative permittivity and is sensed by a capacitive proximity sensor. The web may be plugwrap material for cigarette filter rod, the adhesive being provided to anchor filter tow in position when the plugwrap is wrapped around it. The method avoids various disadvantages associated with other automatic monitoring devices such as optical devices and infra-red devices.

7 Claims, 2 Drawing Figures

MONITORING A DEPOSIT ON A TRAVELLING WEB

TECHNICAL FIELD

The invention was initially designed to monitor continuously a thin line of adhesive deposited on a travelling web of paper which is subsequently wrapped around a tow of filter material to form a filter rod for cigarettes. Such paper is traditionally white and typical adhesives have the same colour which makes it difficult to detect any accidental failure by the adhesive applicator. The deposited adhesive is used to anchor the filter material in position when the paper web is wrapped around it to form the continuous filter rod. Should the adhesive fail to be deposited on the paper web a considerable length of faulty filter rod may be produced by a high speed rod-making machine before the fault is detected and remedial action can be taken.

There are various kinds of sensors available but for one reason or another these are not suitable for monitoring the deposited adhesive. One kind of sensor uses reflected light, another uses light transmitted through the paper, but their respective operations suffer from the disadvantages that it is difficult to distinguish the white adhesive on its white carrier web and furthermore the lighting in the operating region of the sensor may vary, e.g. by reflection from adjacent machine surfaces or from the presence of personnel. Another form of sensor uses infra-red light but this too can be influenced by any adjacent heat source.

The present invention arose from the realisation that if the adhesive deposited on the paper web is selected to have a relative permittivity (formerly called dielectric constant) which is sufficiently high to distinguish it from the carrier web a capacitive sensor known per se can be used to detect any omission of the adhesive without incurring any of the disadvantages referred to above in connection with other kinds of sensor.

The present invention is not however limited in its application to adhesive applied to a plugwrap material.

INVENTION

Method of monitoring a liquid substance applied to a travelling web of material to check for accidental omission of the substance, which method comprises:

(a) applying to a travelling web of material a liquid substance which has a relative permittivity sufficiently high to distinguish it from the web material, (b) passing the web carrying the substance through the field of a capacitive proximity sensor forming part of an electric circuit which is adapted to initiate a desired response where an omission of the adhesive is sensed by the sensor.

DRAWINGS

By way of example the invention will now be described with reference to the following diagrammatic drawings of which:

Figure 1:
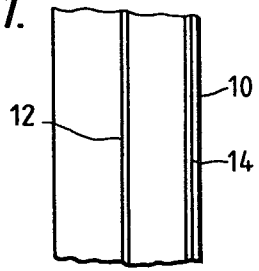
FIG. 1 shows a length of paper web carrying a deposited line of liquid adhesive.

Referring to the drawings a web of permeable paper 10 for use as plugwrap in a machine for making cigarette filter rods is drawn past the nozzle 11 of an adhesive applicator which deposits on the web a continuous thin line of liquid adhesive 12 which extends parallel to the opposing sides edges of the web. The adhesive 12 is provided to anchor cigarette filter material to the plugwrap when the latter is subsequently wrapped around the filter material to form continuous filter rod. The web carrying the adhesive 12 is drawn past the sensing head of a capacitive proximity sensor 13 but without touching it. A liquid adhesive 14 for the lap or seam seal of the wrapped plugwrap is deposited on the web 10 in a continuous thin line parallel to the line of anchorage adhesive 12 and then the web carrying the two lines of adhesive is guided to enter a garniture on a known rod-making machine (not shown) which wraps the web around a tow of filter material to form a continuous filter rod having a longitudinal lap seal. The adhesive 12 which is now on the inner surface of the tubular plugwrap serves to anchor the two in position. The continuous filter rod is then cut transversely into lengths of multiple rod sections which pass to a fluted transfer drum. For the purpose of this invention the drum is provided with an air jet ejection system for faulty rods, i.e. those whose plugwrap lacks the required anchorage adhesive. The acceptable rods are then discharged onto conveyor trays which carry them to a cigarette making machine. An example of such a filter rod-making machine which may be adapted to carry out the present invention is the HAUNI KDF2 machine. The paper web and the adhesive 12 have the same colour to avoid staining the web. Conventionally the colour is white. The adhesive 12 is preferably polyvinyl acetate in aqueous emulsion, its composition being PVA solids 40–70% by weight with the remainder water. An alternative adhesive is a starch adhesive made with water. Whatever the adhesive chosen it must have a relative permittivity which is sufficiently high to distinguish it from the web material and thus facilitate the operation of the sensor.

The sensor 13 for sensing an absence or omission of adhesive 12 which may be total or partial, e.g. an interruption in a line of such adhesive, has a sensing head located close to but spaced from a guided straight path of the web 10 and directed at where the line of adhesive 12 should appear. The sensor which forms part of electrical circuitry is used to generate an electro-static field in the target area which crosses the path of the web.

When a substance solid or liquid enters this field the capacitance is changed and a switch is operated. Consequently the sensor 13 can be set to sense the accidental absence of the water-containing adhesive.

A suitable capacitive proximity sensor is marketed by Hymatic Industrial Controls Limited of Worcestershire under the registered trade mark PROXISTOR. With the particular sensor the capacitive figures listed below illustrate how the water-containing adhesive can affect the field of the sensor 13.

| Material | Capacitive |
|---|---|
| Mild Steel | 1.0 |
| Water | 0.65 |
| PVA | 0.5 |
| Plugwrap (paper) | <0.1 |

Figure 2:
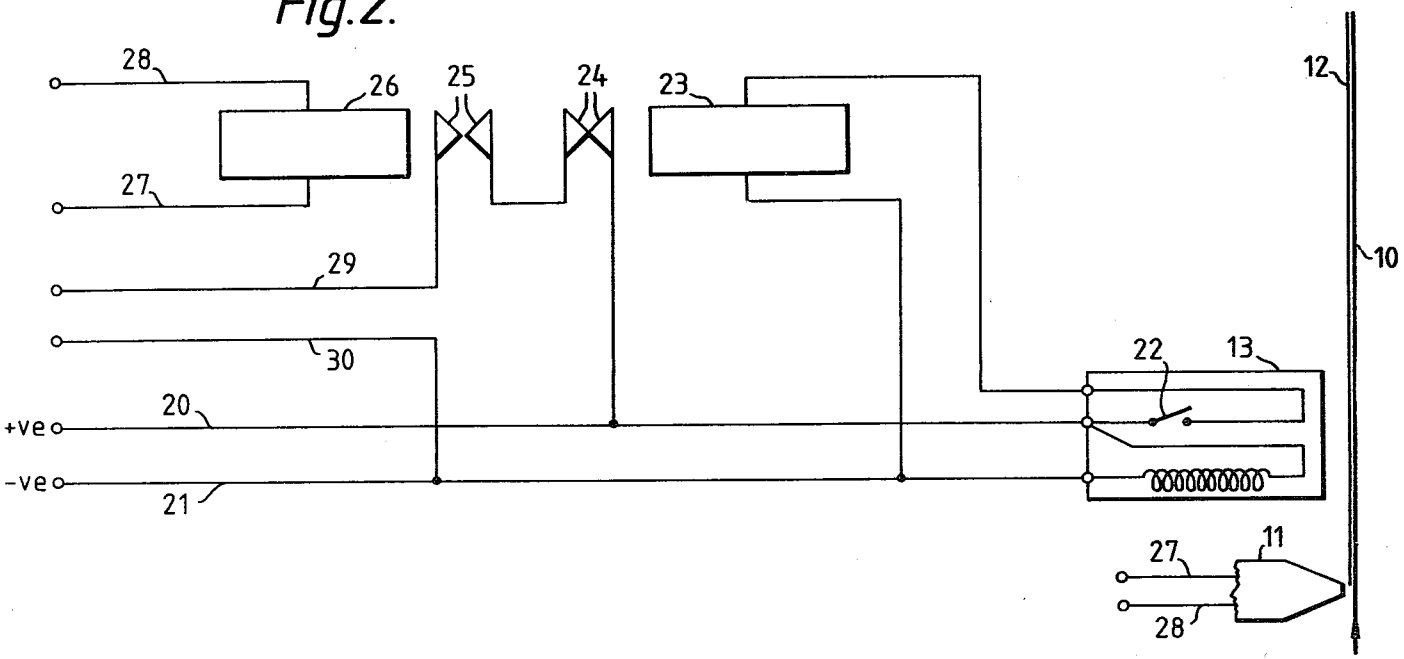
FIG. 2 shows a capacitive proximity sensor and its associated electric relay circuitry, a travelling paper web and the nozzle of an adhesive applicator.

Referring to FIG. 2 the sensor 13 which is connected to power lines 20, 21 includes a proximity switch 22 shown in its normal open position before operation. The sensor is connected to a first relay 23 for opening a first pair of contacts 24 which are biassed to a closed position and is also connected via power line 20 to one of the contacts 24. A second relay 26 for closing a second pair of contacts 25 which are separate from the first pair and are biassed to an open position is connected to a solenoid for a supply valve in the adhesive applicator 11 via lines 27, 28. Finally, two lines 29, 30 one connected to a contact 25 the other to the power line 21 lead to a relay (not shown) for actuating the air jet system for ejecting faulty filter rod from the rod-making machine which receives the web 10 after deposit of the lap seal adhesive 14. The sensor 13 is mounted on a bracket secured to the rod-making machine with its sensing face parallel to the web path. The sensing face is spaced from the web path, e.g. by 2 mm, to avoid physical contact with the adhesive.

The above-described monitoring system may be operated as follows. A motor for driving the web 10 is started up and then the supply valve in the applicator is opened to allow a pumped supply of liquid adhesive 12 to be deposited by the nozzle 11 on the web travelling past it. This operation of the solenoid to open the supply valve causes the second relay 26 to be energised and close the contacts 25. Thus both sets of contacts are now closed. As soon as the sensor 13 which is scanning the web 10 senses the deposit of adhesive 12 its proximity switch 22 is automatically closed, the first relay 23 becomes energised to open the contacts 24 and thereby break the circuit for the rod ejector mechanism. If and when the sensor 13 senses an interruption in the line of deposited adhesive 12, i.e. a lack of future internal anchorage for the filter tow, its proximity switch 22 is automatically opened, whereupon the relay 23 becomes inoperative, the contacts 24 are freed to close and the relevant circuit is energised via line 29 to cause the now faulty filter rod to be ejected from the rod-making machine at a point upstream of its normal discharge. Thus the ejector system only operates when both the proximity switch 22 and the adhesive supply valve are open.

The invention has proved so reliable that it is sufficient to have only a single line of adhesive 12 for anchorage of the filter tow to its plugwrap.

The capacitive proximity sensor has the advantages that it can be located out of contact with the travelling web, thereby increasing the scanned area and avoiding contact with the adhesive, it can be located on either side of the web, its operation is not affected by proximity of a metallic and possibly vibrating rod-making machine and it is not affected by ambient light or by an adjacent heat source.

I claim:

1. In an adhesive application machine a method of monitoring a liquid adhesive applied to a travelling web of material prior to application of the web to an article in the machine, to check for absence of the adhesive from the web, which method comprises, (a) applying to a travelling web of material by means of an applicator valve a liquid adhesive which has a relative permittivity sufficiently high to distinguish it from the web material, (b) sensing whether the applicator valve is open and generating a first electrical signal in response to the applicator valve being open, (c) passing the web carrying the adhesive through the field of a capacitive proximity sensor, (d) determining by means of the proximity sensor the presence or absence of the adhesive on the web and generating a second electrical signal if the adhesive is absent from the web, (e) applying the web to the article, and, (f) generating a third electrical signal consequent on the simultaneous presence of the first and second signals and (g) actuating by the third signal a means to eject the article and web from the machine at a point distinct from its point of normal exit.

2. Method according to claim 1, wherein the web material is a plugwrap material for wrapping around cigarette filter material, the liquid substance is an adhesive for anchoring the filter material to the plug material, and the plugwrap material after passing the sensor is wrapped around cigarette filter material in a filter rod-making machine.

3. Method according to claim 2, wherein the anchorage adhesive is applied to the web of plugwrap material as a single line, which line is parallel to the opposing side edges of the web.

4. Method according to claim 2, wherein the adhesive includes water.

5. Method according to claim 4 wherein the adhesive is polyvinyl acetate.

6. Method according to claim 1, wherein the web material and the liquid substance have same colour.

7. A method according to claim 1, wherein the proximity sensor has a sensing face which is spaced from the path of the web, which spacing increases the area of scan by the sensor.

* * * * *